United States Patent [19]

Roberts

[11] Patent Number: 4,832,644

[45] Date of Patent: May 23, 1989

[54] HEEL PROTECTOR FOR SWIM FIN

[76] Inventor: Elizabeth B. Roberts, 3972 Barranca Pkwy. Suite J-458, Irvine, Calif. 92714

[21] Appl. No.: 36,920

[22] Filed: Apr. 10, 1987

[51] Int. Cl.[4] ..... A63B 31/10

[52] U.S. Cl. ..... 441/64; 36/114; 36/11.5

[58] Field of Search ..... 441/55-64; 36/89, 96, 105, 114, 7.4, 7.5, 11.5, 35 R; 2/2, 267, 268

[56] References Cited

U.S. PATENT DOCUMENTS

| | | | |
|---|---|---|---|
| 2,823,383 | 2/1958 | Crawford | 2/2 |
| 3,154,787 | 11/1964 | Newman | 2/2 |
| 3,775,873 | 12/1973 | Small | 36/11.5 |
| 3,908,213 | 9/1975 | Hill | 441/64 |
| 3,913,158 | 10/1975 | Vilarrubis | 441/64 |
| 4,314,412 | 2/1982 | Anderson et al. | 36/11.5 |
| 4,575,874 | 3/1986 | Johnson | 2/2 |

FOREIGN PATENT DOCUMENTS

| | | | |
|---|---|---|---|
| 1078913 | 3/1960 | Fed. Rep. of Germany | 441/64 |
| 164366 | 8/1958 | Sweden | 441/64 |

*Primary Examiner*—Sherman D. Basinger
*Assistant Examiner*—Stephen P. Avila
*Attorney, Agent, or Firm*—Knobbe, Martens, Olson & Bear

[57] ABSTRACT

A heel protection device for the heel strap of a conventional swimfin is disclosed, which protects the wearer from bruising, blistering, and chafing of the foot while wearing and using the swimfin. The heel protector is made of a sheet of polymer foam material and has a body portion with a width and a length with the length being larger than the width, and tabs on opposite sides of the body, with the width of the body between them. Fasteners are provided on the tabs for fastening the protector around the heel strap of a swimfin. Also disclosed is a method for making the device and a method for using the device.

16 Claims, 2 Drawing Sheets

Fig. 1
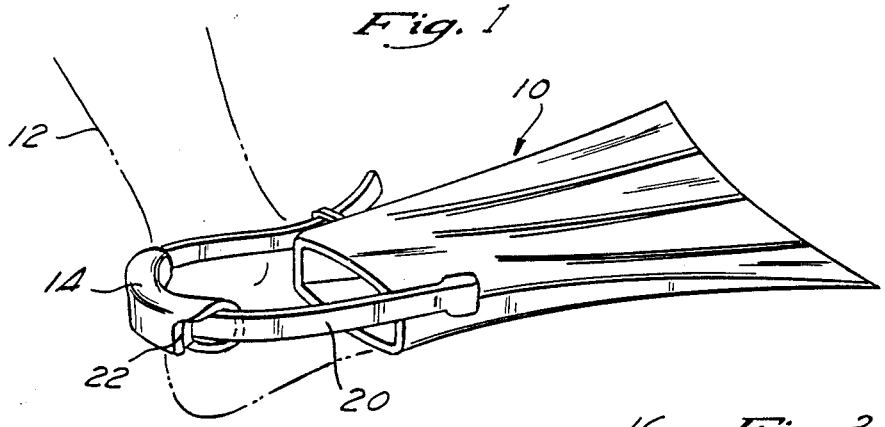
Fig. 2
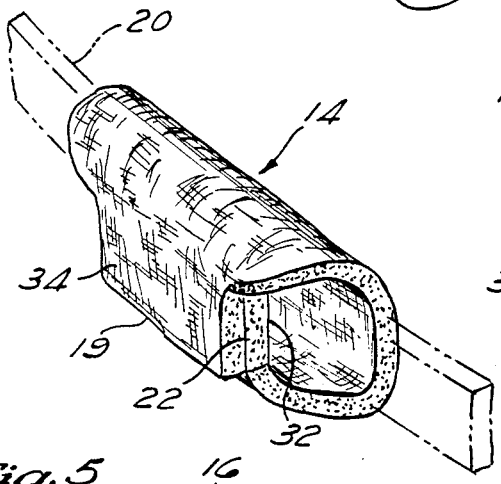
Fig. 3
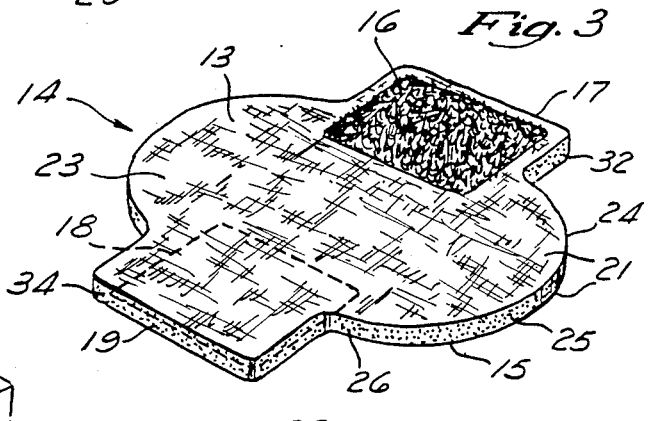
Fig. 5
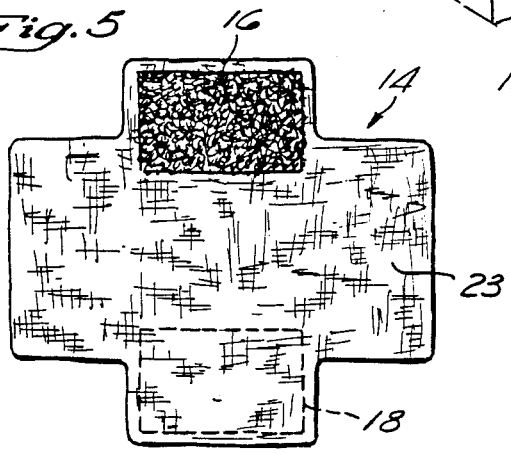
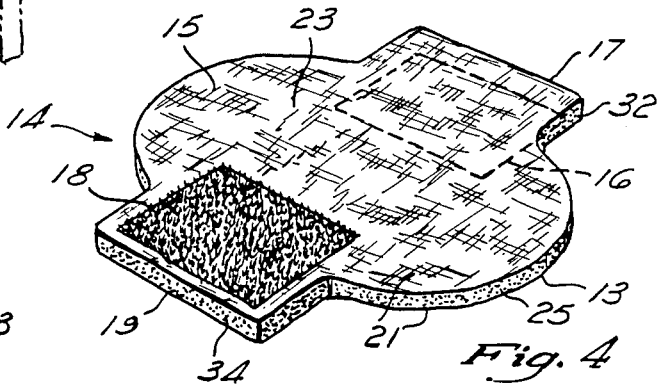
Fig. 4
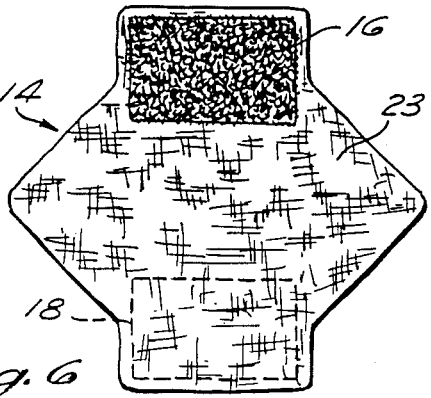
Fig. 6
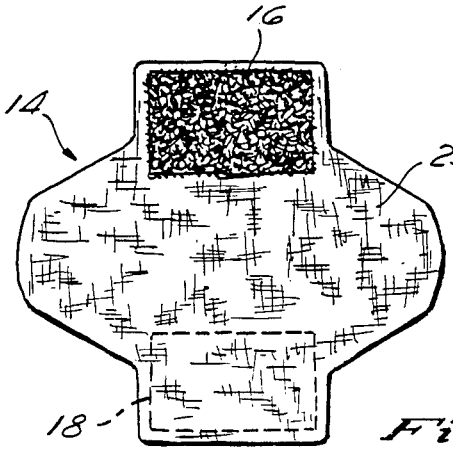
Fig. 7

Fig. 8
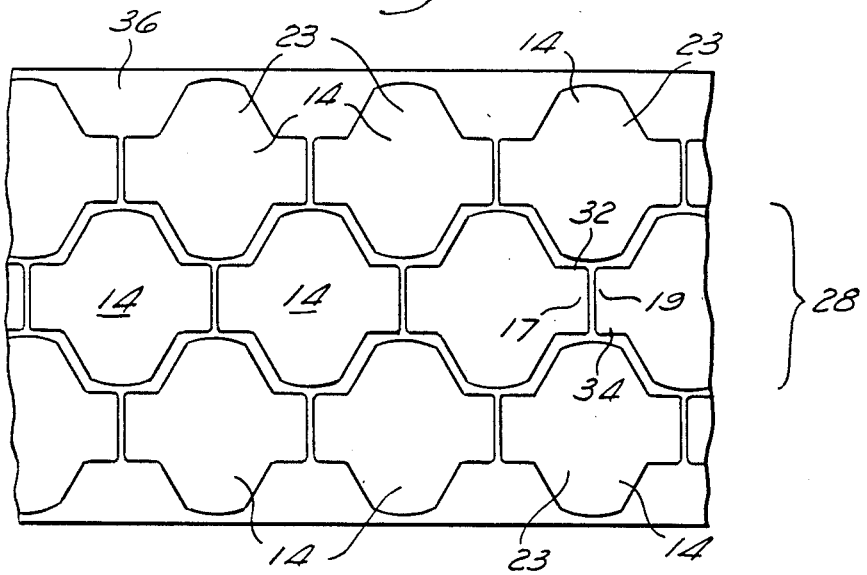
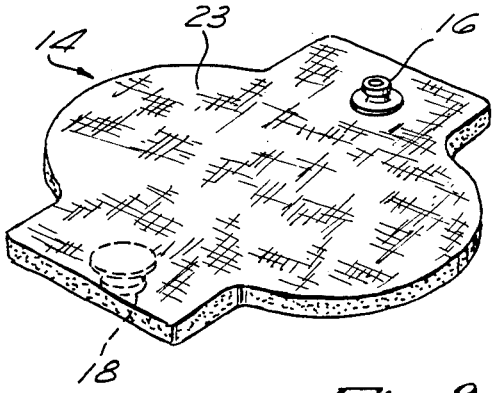
Fig. 9

HEEL PROTECTOR FOR SWIM FIN

BACKGROUND OF THE INVENTION

This invention relates generally to pads and chafing protection devices for use on the strap of a swimfin.

There are many common uses for conventional swimfins. A particularly popular use is for propelling and controlling the body while riding waves at the beach. This may be accomplished without any further artifices or devices, in which case such activity is known as "body-surfing." Alternatively, it may be accomplished with the aid of a lightweight kick-board, such as that marketed under the trademark "Morey Boogie-Board."

Training programs for competitive swimmers often involve up to 10,000 meters per day in the pool. Several thousand meters of that total may involve the use of swimfins. The widespread enjoyment of these activities, however, has led to several problems. The heel strap of most conventional swimfins, which is used to hold the fin onto the foot of the wearer, is typically made of a semi-rigid plastic or rubber material. The combination of the rigidity of the strap, the tightness with which it must be worn, and the movement of the ankle joint during use often result in chafing or bruising of the wearer's heel and achilles tendon. In addition, swimmers often experience blisters and abrasions on other parts of the foot as a result of friction between the foot and the fin. The discomfort generated from this chafing, bruising, or blistering can greatly diminish, or may entirely prohibit, the enjoyment of these activities.

In an effort to eliminate these problems, many swimfin users have resorted to wearing bandages or other protective devices, such as old socks, on their feet during use of the swimfin. In addition, manufacturers have redesigned some models of their swimfins to accommodate a specialized foam neoprene shoe, or "bootie," which serves to insulate and isolate the wearer's foot from the fin and straps. These solutions have the disadvantages of being ineffectual and inconvenient, or of requiring the use of a specialized swimfin and bootie, which are also inconvenient, more expensive, and less readily available.

Accordingly, it is an object of the present invention to provide an effective heel protection device which avoids the problems of ineffectiveness, expense, unavailability, or inconvenience of currently available foot protection devices.

It is a further object of the present invention to provide the wearer with a comfortable and inexpensive means of protecting the heel and achilles tendon areas from chafing or bruising while using conventional swimfins.

Yet another object of the present invention is to provide a means for adjusting the fit of swimfins to reduce blistering and fin loss caused by poor or loose fit.

SUMMARY OF THE PRESENT INVENTION

The present invention provides a heel protection device for use with a swimfin, which is wrapped around the heel strap of the swimfin prior to use. Installation of the heel protector eliminates bruising of the achilles tendon and chafing of the skin of the heel. Moreover, the fit of standard-sized fins can be adjusted by using the heel protector, reducing or eliminating the tendency of the fin to cause blisters and abrasions on the foot, and also to reduce the danger of losing fins in the surf.

The heel protector is constructed having a body with a first and a second face, formed from a web of polymer foam material. The protector body has a length and a width, with the length preferably being greater than the width, and may variously be in the shape of an oval, ellipse, rectangle, or other polygon or closed curve. A sheet of fabric, such as spandex or nylon, may be bonded to the first or second face (or both) of the body of the heel protector. The protector body further comprises a first edge on a first side of the body, and a second edge on an opposite second side of the body.

In one embodiment of the invention, a first and second tab are located on the opposite first and second sides of the body of the heel protector to which are affixed a first and a second fastener, with the width of the body between them. The first fastener is attached to the first face of the heel protector, and the second fastener is typically attached to the second and opposite face, although a second embodiment includes placing the second fastener onto the second tab on the same face as the first fastener on the first tab. The first and second fastener are further oriented such that they will interconnect after the heel protector has been wrapped around the heel strap of the swimfin.

The first and second fasteners are preferably comprised of hook and pile fasteners, which are sewn onto the body or the tabs of the protector, but may also advantageously be bonded to the tabs or the body with a suitable adhesive or other bonding means. The first and second fasteners may also be comprised of snaps, buttons, zippers, ties, or lacings. These various fasteners provide convenient and secure attachment of the heel protector to the strap of the swimfin.

BRIEF DESCRIPTION OF THE DRAWINGS

FIG. 1 is a perspective view of the heel protector while in use, with the wearer's foot shown in phantom;

FIG. 2 is a perspective view of the heel protector wrapped around the heel strap of a conventional swimfin (shown in phantom) and fastened;

FIG. 3 is a perspective view of one side of the heel protector in an unfastened state, prior to installation onto the heel strap of the swimfin, with a first fastener shown in solid and a second fastener shown in phantom.

FIG. 4 is a perspective view of the other side of the heel protector of FIG. 3, with the second fastener shown in solid and the first fastener shown in phantom.

FIGS. 5, 6, and 7 are plan views of various alternative configurations of the heel protector body.

FIG. 8 is a schematic of a web of polymer foam material from which the heel protectors are cut, illustrating a pattern for cutting multiple heel protectors from that web.

FIG. 9 is a perspective view of one side of the heel protector in an unfastened state prior to installation onto the heel strap , showing an alternative fastening method comprising snaps.

DETAILED DESCRIPTION OF THE INVENTION

The current invention provides a heel protection device, and is intended to be utilized in conjunction with a conventional swimfin 10, to provide increased comfort and prevent chafing or bruising of the heel or achilles tendon of a wearer 12, while engaging in swimming, skindiving, body-surfing, or "Boogie-boarding."

With reference to FIG. 3, a heel protector 14 is provided comprising a shaped sheet of polymer foam material having a first face 13 and a second face 15, and having a length and a width, with the length being greater than the width, and having an edge along a first side 17 and a second edge along a second side 19, opposite to the first side 17. The heel protector 14 has a body 23 which is typically shaped as an ellipse, but may also be advantageously shaped as an octagon, hexagon, oval, rectangle or other polygon, wherein the polygons preferably are not regular polygons, but preferably have a length and a width, with the length being greater than the width. The body 23 of the heel protector 14 may be made of any suitable polymer foam material, such as polyurethane, polyethylene, butyl rubber, latex rubber, or neoprene foam. Neoprene is particularly preferred. Such foam material preferably is between about 1 mm and 10 mm thick, more preferably between about 2 mm and about 7 mm thick, and most preferably between about 3 mm and about 6 mm thick. Closed cell foam is particularly preferred. Closed cell neoprene foam in 3–6 mm thicknesses is readily available as wetsuit material with lycra facing fabric on one or both sides thereof.

The body 23 of the heel protector 14 may be faced with a fabric 21, on either the first face 13 or the second face 15, or both. The fabric 21 bonded to the face of the body 23 is typically a nylon or spandex material, such as that marketed under the trademark "Lycra." The inclusion of the fabric 21 serves the purposes of providing increased strength, abrasion and wear resistance, and improves the comfort and the aesthetics of the heel protector 14. The fabric 21 may advantageously be selected for its pleasing colors and patterns. Sizes, logos, trademarks, or designs also may be provided on the fabric 21.

Additionally, the first edge 24 along the first side 17, and the second edge 26 along the second side 19, may be circumferentially covered with a finishing material 25 such as fabric bias tape or a polymer film, in order to prevent wear of the heel protector, and to enhance its aesthetic appeal and comfort. The finishing material 25 may alternatively be sewn to the first and second edges of the first and second sides 17, 19, or may be bonded thereto utilizing a suitable adhesive.

Referring to FIGS. 2 and 3, a first tab 32 is provided along the first side 17 of the body 23 of the heel protector 14, and a second tab 34 is provided along the second side 19 opposite the first side 17 of the body 23. These tabs 32, 34 are preferably simply an extension of the polymer foam material of which the body 23 is formed and are integral with the body 23. The first tab 32 and second tab 34 provide a first and second location for attachment of a first fastener 16 and a second fastener 18. The first tab 32 and the second tab 34 provide a mutual overlapping attachment point 22 when the protector is wrapped around the heel strap 20 of the swimfin 10. A substantial overlap of the first and second tabs 32, 34 at the attachment point 22 when the heel Protector is wrapped around a heel strap 20 permits attachment of the heel protector 14 to itself at a plurality of positions, thus enabling the wearer 12 to adjust the fit of the heel protector 14 to a variety of heel straps 20 of differing sizes.

In a typical embodiment, the first fastener 16 is provided on a first face 13 of the first tab 32, and the second fastener 18 is typically provided on a second face 15 of the second tab 34. When the heel protector 14 is wrapped around the swimfin 10 heel strap 20, the fasteners 16 and 18 are located adjacent to each other, and can attach together along an area of mutual contact at the attachment point 22.

The heel protector body 23 is preferably about 70–170 mm in length and about 50–100 mm wide. Of course, the actual dimensions will depend on the particular swimfin strap with which the protector 14 will be used. The tabs 32, 34 may advantageously each be about 20–35 mm in width, and about 30–50 mm in length (wherein the length of the tabs 32, 34 is measured in the same direction as the length of the body 23). The overall width of the heel protector 14 is the sum of the widths of the body 23 and the tabs 32, 34, and may advantageously be 70–170 mm, or about the same as the length of the heel protector 14.

While the first fastener 16 and second fastener 18 are preferably hook and pile material, such as the material marketed under the trademark "Velcro," other embodiments may comprise any one of a number of other types of fastening means, including, but not limited to, snaps, buttons, zippers, hooks, ties, and lacing.

In an alternate embodiment, the first tab 32 and the second tab 34 may be omitted, and the first fastener 16 and the second fastener 18 may be located directly on the first side 17 and second side 19 of the heel protector body 23. In this alternate configuration, the first fastener 16 is located on the first side 17 of the first face 13 of the body 23, and the second fastener 18 is located on the opposite side 19 of the same face 13 of the body 23.

With reference to FIG. 9, instead of hook and pile material, the first fastener 16 and second fastener 18 may advantageously comprise a snap fastener.

In the alternate embodiment wherein the first and second tabs 32, 34, have been omitted, the first fastener 16 and second fastener 18 may comprise hook and pile fasteners, and the first fastener 16 may be configured so as to extend out from the first side 17, in order to facilitate attachment to the second fastener 18 located on the opposite side 19 of the body 23 without overlap of the polymer foam material of the body 23.

With reference to FIG. 4, a typical heel protector 14 is symmetric with respect to the body 23 shape, and with respect to the first and second fastener means 16, 18, on the first face 13 and the second face 15. A plurality of other configurations of the protector body 23 are possible, including generally rectangular (shown in FIG. 5, with the first fastener 16 shown in solid and the second fastener 18 shown in phantom), generally hexagonal (shown in FIG. 6, with the first fastener 16 shown in solid and the second fastener 18 shown in phantom) or generally octagonal (shown in FIG. 7, with the first fastener 16 shown in solid and the second fastener 18 shown in phantom). These various shaped bodies have a width and a length, with the length preferably being greater than the width. However, with tabs 32, 34, the overall width of the heel protector 14 is generally about the same as the length of the heel protector 14.

Any suitable manufacturing process may be used to make the heel protectors of the present invention. Both hand processes and automated processes may be used. With reference to FIG. 8, multiple heel protectors 14 may be cut from a single web of polymer foam material 36. A pattern of uncut heel protectors 14 is provided. That pattern may advantageously comprise a plurality of rows of protectors 14 with a first row 28 of heel protectors 14 arranged having the first tab 32 on the first side 17 of the body 23, and the second tab 34 on the second, opposite side 19 of the body 23 of the protector 14, with the width of the body 23 between the first tab 32 and second tab 34, wherein the first tab 32 of a first uncut protector 14 abuts the second tab 34 of a first adjacent uncut protector 14 in the same row, and wherein the second tab 34 of the first uncut protector 14 abuts the first tab 32 of a second adjacent protector 14.

Each adjacent row 28 of uncut heel protectors is laterally displaced by a distance of one-half of the width or length of a protector 14, from each next adjacent row, such that the patterns form an interlocking arrangement. The interlocking pattern arrangement of FIG. 8 results in a minimum amount of wasted polymer foam material 36 during the process of cutting out protectors 14.

The protectors 14 may be cut from the single web of Polymer foam material 36 by the use of a die, and the use of a rotary die and/or a heated die may be particularly advantageous. A heated die, heated above the softening point of the fabric 21, minimizes unraveling of the fabric 21 and can seal the cut edges thereof. Additionally, in one embodiment of the invention, a laser may be used to cut the protector bodies from the web of polymer foam material.

The present invention also includes a method for using the aforementioned heel protectors. In this method, a heel protector is obtained which has the characteristics described above. The method then includes the steps of wrapping the protector around the heel strap of a swimfin prior to use of the swimfin, and fastening the heel protector onto the swimfin strap through use of the fasteners provided on the protector. The swimfin is then used in the conventional manner, with a significant increase in comfort and a significant decrease in chafing and bruising of the user's heel.

The present invention also comprehends the combination of the aforedescribed heel protector 14 and a swimfin 10, with the heel protector 14 fastened around the heel strap 20 of the swimfin 10 with the body portion 23 on the side of the strap 20 adjacent to the wearer's heel and the fasteners 16, 18 connected together on the side of the strap 20 that is away from the wearer's heel.

Although the invention has been described in the context of certain preferred embodiments, it is intended that the scope of the present invention be determined soley by reference to the claims that follow, and reasonable equivalents thereof.

What is claimed is:

1. A heel protector for protecting the heel of a user of swimfins having a heel strap, comprising:

a body, comprising a shaped sheet of polymer foam material separate from a swimfin, having a first face and a second face, said sheet having a length and a width, and with the length being greater than the width, and having a first edge on a first side of the body, and a second opposite edge on a second side of the body; and fasteners on first and second opposite sides of first and second opposite faces of the body with the width of the body between them, capable of securing the sheet of polymer foam material around the heel strap of a swimfin.

2. The heel protector of claim 1, wherein the polymer foam material is closed cell neoprene foam.

3. The heel protector of claim 1, wherein the polymer foam material is faced on one side with fabric.

4. The heel protector of claim 3, wherein the fabric is a spandex material.

5. The heel protector of claim 3, wherein a portion of the fabric comprises nylon.

6. The heel protector of claim 1, further comprising a first tab on a first side of the body, and a second tab on a second, opposite side of the body, with the width of the body between the first and second tabs.

7. The heel protector of claim 6, wherein the fasteners are located on the first and second tabs on the first and second sides of the body of the protector.

8. The heel protector of claim 6, wherein the fasteners comprise snaps.

9. The heel protector of claim 6, wherein the fasteners comprise a hook and pile fastener.

10. A heel protector for protecting the heel of a user of swim fins having a heel strap, comprising:

a body comprising a shaped sheet of polymer foam material separate from said swim fin, having a first face and a second face, said sheet having a length and a width, and with the length being greater than width, and having a first edge on a first side of the body, and a second opposite edge on a second side of the body;

fasteners on opposite sides of the body with the width of the body between them, capable of securing the sheet of polymer foam material around the heel strap of a swim fin;

a first tab on a first side of the body; and a second tab on a second, opposite side of the body, with the width of the body between the first and second tabs, wherein the fasteners are placed on the first and second opposite sides of the first and second faces of the polymer foam heel protector.

11. A heel protector for protecting the heel of a user of swim fins having a heel strap, comprising:

a body comprising a shaped sheet of polymer foam material separate from said swim fin, having a first face and a second face, said sheet having a length and a width, and with the length being greater than the width, and having a first edge on a first side of the body, and a second opposite edge on a second side of the body;

fasteners on opposite sides of the body with the width of the body between them, capable of securing the sheet of polymer foam material around the heel strap of a swim fin;

a first tab on a first side of the body; and a second tab on a second, opposite side of the body, with the width of the body between the first and second tabs, wherein the fasteners are integrally bonded to the first and second faces of the polymer foam heel protector.

12. A heel protector for protecting the heel of a user of swim fins having a heel strap, comprising:

a body comprising a shaped sheet of polymer foam material separate from said swim fin, having a first face and a second face, said sheet having a length and a width, and with the length being greater than the width, and having a first edge on a first side of the body, and a second opposite edge on a second side of the body;

fasteners on opposite sides of the body with the width of the body between them, capable of securing the sheet of polymer foam material around the heel strap of a swim fin;

a first tab on a first side of the body; and a second tab on a second, opposite side of the body, with the width of the body between the first and second tabs, wherein the fasteners are sewn onto the first and second faces of the polymer foam heel protector.

13. A heel protector for protecting the heel of a user of swim fins having a heel strap, comprising:

a body comprising a shaped sheet of polymer foam material separate from said swim fin, having a first face and a second face, said sheet having a length and a width, and with the length being greater than the width, and having a first edge on a first side of the body, and a second opposite edge on a second side of the body;

fasteners on opposite sides of the body with the width of the body between them, capable of securing the sheet of polymer foam material around the heel strap of a swim fin;

a first tab on a first side of the body; and a second tab on a second, opposite side of the body, with the width of the body between the first and second tabs, wherein the fasteners are attached to the first and second faces of the polymer foam heel protector by an adhesive.

14. The heel protector of claim 6, wherein the fasteners provide a means for adjusting the heel protector to fit the strap of a swimfin.

15. The heel protector of claim 1, further in combination with a swimfin having a heel strap, wherein the heel strap has an inside and an outside, and the heel protector is wrapped around the heel strap so that the body of the heel protector is on the inside of the heel strap and the fasteners are fastened together on the outside of the heel strap.

16. A method for protecting the heel of the wearer of a swim fin having a heel strap comprising the steps of:

obtaining a polymer foam heel protector wherein the protector comprises:

a body, comprising a shaped sheet of polymer foam material, having a first face and a second face, said sheet including a length and a width, and with the length being greater than the width, and having a first edge on a first side of the body, a second opposite edge on a second side of the body, a first tab on a first side of the body, and a second tab on a second, opposite side of the body, with the width of the body between the first and second tabs, and fasteners placed on the first and second opposite sides of the first and second faces of the body with the width of the body between them, capable of securing the sheet of polymer foam material around the heel strap of a swim fin;

wrapping the protector around the heel strap of a swim fin prior to use, and fastening the heel protector fasteners, to secure the protector onto the swim fin.

* * * * *